United States Patent [19]

Tsuji

[11] Patent Number: 4,717,260

[45] Date of Patent: Jan. 5, 1988

[54] TIME DIFFERENTIAL CORRECTING ANALOG TIMEPIECE OF TWENTY-FOUR HOUR SYSTEM

[76] Inventor: Shigeru Tsuji, 9-1-205, Sanno 2-chome, Ota-ku, Tokyo, 143, Japan

[21] Appl. No.: 935,468

[22] PCT Filed: Jan. 24, 1986

[86] PCT No.: PCT/JP86/00026

§ 371 Date: Nov. 4, 1986

§ 102(e) Date: Nov. 4, 1986

[87] PCT Pub. No.: WO86/05287

PCT Pub. Date: Sep. 12, 1986

[30] Foreign Application Priority Data

Mar. 4, 1985 [JP] Japan ..... 60-41329

[51] Int. Cl.[4] ..... G04B 19/22

[52] U.S. Cl. ..... 368/21

[58] Field of Search ..... 368/21-22, 368/25-27, 223, 228

[56] References Cited

U.S. PATENT DOCUMENTS

| | | | |
|---|---|---|---|
| 2,305,508 | 12/1942 | Woodrupp | 368/21 |
| 2,654,213 | 10/1953 | Galley | 368/21 |
| 2,910,825 | 11/1959 | Krikwood | 368/21 |
| 3,271,945 | 9/1966 | Anderson | 368/21 |
| 3,382,666 | 5/1968 | Gerry | 368/21 |
| 3,503,203 | 3/1970 | Mutter et al. | 368/21 |
| 4,347,594 | 8/1982 | Tschanz | 368/21 |

FOREIGN PATENT DOCUMENTS

| | | |
|---|---|---|
| 53-56850 | 5/1978 | Japan . |
| 314050 | 7/1956 | Switzerland . |

*Primary Examiner*—Vit W. Miska

*Attorney, Agent, or Firm*—Armstrong, Nikaido, Marmelstein & Kubovcik

[57] ABSTRACT

A timepiece of a twenty-four hour system for travelers, which is capable of correcting a time differential by one touching operation. A movable main dial (D1) is turned to merely align the index number of a destination with that of a departure place on a sub-dial (D2). The numerals of 1–24 on an hour numeral band indicate the hours and also function as codes which represent the time zones of between GMT−11 and GMT+12, and an auxiliary index (C) is provided to supplement these codes therewith. The timepiece is made on the basis of such a "global time series (GTS) system" which constitutes a novel device. A variable pattern band (V) which equally stretches over a movable band (K) and a timepiece body is made so that it shows two modes of variations in a normal time position and a half time position. Owing to this arrangement, the time in all time zones in the world including the time differentials of a unit time of thirty minutes can be displayed.

3 Claims, 20 Drawing Figures

TIME DIFFERENTIAL CORRECTING ANALOG TIMEPIECE OF TWENTY-FOUR HOUR SYSTEM

TECHNICAL FIELD

This invention relates to an analog 24 hour timepiece which is capable of correcting a time differential, convenient especially for the traveller's use.

BACKGROUND OF THE INVENTION

To correct a time difference with a timepiece of normal use while travelling, we must move the hands each time after a complicated calculation of the time difference. It is extremely troublesome and inconvenient because we have to check with the radio time signal if we want exactness. Many devices for the solution of this problem have been attempted up to now, but none of them is definitive. One of the many devices, best for the solution, I believe, is to move the dial instead of the hands for adjusting the time differential. This system is partially adopted on a watch by R. Corp. of Switzerland, which has a 24 hour hand in addition to the 12 hour hand and a 24 hour dial ring around its main body. But with this watch, we have to read the time from two separate hands on two different hour dials. This is, in fact, not different from using two watches, one of a 12 hour system and another of a 24 hour system, together. Other timepieces currently in circulation, called "World Time Clocks" are worthy of use whenever information on the times in foreign countries is needed whilst remaining in the home country, but not useful when visiting different places while travelling or using there in daily life. The same system is adopted on a wrist watch of T. Corp. of Switzerland, but the indication of the time in the foreign country is too complicated to read and inconvenient for the traveller's use.

The timepiece of this invention is based exclusively on the 24 hour system, and this is it's most distinctive characteristic from the timepieces in common use today. However this idea of the 24 hour system is not novel and has really existed since the medieval age. For instance, in Italy in the 15th century, an example of a clock of this type was represented in a wall-painting by Botticelli, and Paolo Uccello did a decoration on the wall-clock in the cathedral of Florence which we can still see today. This type of clock has really been known a very long time, but the examples were confined to rather large scale clocks such as those found in public places like cathedrals or those for putting on a desk. Later, the clock became smaller than before and the 12 hour system has become common especially for the portable watch. In this century, the 24 hour system watch has been made for people engaged in special fields such as transport, but it has not been produced to supply popular demand. The 24 hour system has become usual all over the world in traffic time-tables; nevertheless, this has not brought about a drastic change in daily customs or in watches themselves. This seems to indicate that people have not found any necessity as yet for changing the 12 hour system of dividing a day into a.m. and p.m.: first of all, this custom appears to be firmly entrenched in our lives and secondly, most people seem to have a certain "affection" for a 12 hour system watch because of it's simplicity. However, the situation can be changed, if the following two points can be achieved: firstly, if people are offered a timepiece with a novel function realizable only through the 24 hour system, and secondly if the difficult problem of design can be solved.

DISCLOSURE OF THE INVENTION

Today people fly all over the world more and more frequently and countries are interconnected by telecommunications more constantly. With this development in means of communication, we might say that the time has come for a 24 hour system watch because a new function, which can only be achieved through adoption of the 24 hour system, is required. So what is the merit of the 24 hour system's timepiece? It is clear that the maximum time difference between two places in the world being 24 hours, it is convenient if we can see at a glance on the timepiece all the places and their respectives times. Standing at GMT, almost all the time differences are included within $\pm 12$ hours. However, if one is not in London but in, for example, the Far East or Pacific area, then the number of places not included within this 12 hour cycle increases. For travellers from one "local" place to another, both distant from London, it is a big problem to calculate and correct the time difference. To promptly correct the difference between, for example, Tokyo time (GMT+9) and Honolulu time (GMT−10) is not as easy as it is believed. The inconvenience of a 12 hour timepiece will not be noticed so much by Europeans who start from Europe and return there. Other peoples who start travelling from a place far from London, will easily discover the convenience of a 24 hour timepiece, and the merit of the 24 hour system becomes definitive with the adoption of the "GTS System".

GTS are the initials of "Global Time Series", used here for the first time by the inventor of the present timepiece. This idea relates not only to the mechanism of the watch but also to the indication of world standard times. It could be seen as an unified conception of time and space, or as an analogy of the circular dial as the earth. The surface of the earth is divided into 24 zones according to standard local times, and we can regard each number as a code for each zone. There are many ways of assigning the numbers, but the best way, I believe, is to attribute the number 12 to London, arranging the other numbers from 1 to 24 at particular places from the extreme west zone (GMT−11) to the extreme east zone (GMT+12). In this way, the numerals show the times in each zone when it is 12 o'clock in London. In fact, by giving the number 12 the role of GMT in the index: GMT$\pm$A, we can get the GTS code number of anywhere. The traditional GMT system consists of the relation between "central" London and other "local" places, but the GTS system is composed of an equal and relative arrangement of all places. With this GTS System. we can connect, and compare directly, any two places, without having to go through a "middle point" (i.e. GMT) and therefore enabling us to shorten considerably the process of calculation. In adopting the GTS System, the numerals on the dials serve as the code numbers for each time zone besides indicating the hours. To facilitate knowing what the code numbers represent, there is an auxiliary

WORLD TIME TABLE BY GTS SYSTEM

DST: +01
S1 = 30/3-27/9, S2 = 30/3-25/10,
S3 = 27/4-25/10, S21 = 26/10-28/2
S22 = 2/11-14/3, S23 = 12/10-15/3
(June 1986)

| time code number | (GMT) | auxiliary code | main city |
|---|---|---|---|
| 25 | (+13) | | TONGATAPU |
| 24 | (+12) | A~ | AUCKLAND/S21,NADI. 2445 CHATHAM Is/S21 |
| 23 | (+11) | N | NOUMEA,HONIARA, LIFOU. 2330 NORFOLK Is |
| 22 | (+10) | S~ | SYDNEY/S21, PORT MORESBY, GUAM, SAIPAN |
| 21 | (+09) | T | TOKYO, SEOUL, AMBON. 2130 ADELAIDE/S21 |
| 20 | (+08) | H | HONG KONG, SINGAPORE, MANILA. |
| 19 | (+07) | B | BANGKOK, JAKARTA, HANOI |
| 18 | (+06) | D | DHAKA. 1830 RANGOON |
| 17 | (+05) | K | KARACHI, 1730 BOMBAY. 1745 KATHMANDU |
| 16 | (+04) | A | ABU DHABI, MUSCAT. 1630 KABUL |
| 15 | (+03) | J | JEDDAH, MOSCOW/S1, KUWAIT. 1530 TEHRAN |
| 14 | (+02) | A~ | ATHENS/S1, CAIRO, JOHANNESBURG |
| 13 | (+01) | P~ | PARIS/S1, ROMA/S1, FRANKFURT/S1 |
| 12 | (GMT) | L~ | LONDON/S2, LISBON/S1, DUBLIN/S2 |
| 11 | (−01) | | ILHA DO SAL, TERCEIRA/S1 |
| 10 | (−02) | | FERNANDO DE NORONHA |
| 09 | (−03) | S | SAO PAULO/S22, BUENOS AIRES |
| 08 | (−04) | C | CARACAS, SANTIAGO/S23. 0830 GANDER/S3 |
| 07 | (−05) | N~ | NEW YORK/S3, TORONTO/S3, BOGOTA, |
| 06 | (−06) | C~ | CHICAGO/S3, MEXICO CITY, SAN JOSE |
| 05 | (−07) | D~ | DENVER/S3, CALGARY/S3. 0530 COCOS Is |
| 04 | (−08) | L~ | LOS ANGELS/S3, VANCOUVER/S3 |
| 03 | (−09) | A~ | ANCHORAGE/S3, GAMBIER Is |
| 02 | (−10) | H~ | HONOLULU/S3, PAPEETE. 0230 NUKU HIVA |
| 01 | (−11) | | APIA, PAGO PAGO, TARAWA, NIUE |
| 00 | (−12) | | KWAJALEIN |

code, which is composed of the names or initials of main cities, selected as representative of each particular time zone. These cities are to be selected from the data on the numbers of passengers or of flights in the airports of the same cities. The selected data, with the data on DST too, will be presented as the "World Time-Table by the GTS System", and printed on a plastic or paper card, which can be carried in travel. Moreover, the "GTS Emblem", or some GTS auxiliary codes, are to be indicated on the body of watch as the minimum necessary information. The combination of this GTS System with a double 24 hour dial: i.e. a rotating main dial and an immobile subdial, realize the novel and perfect function of this time difference adjuster. Furthermore, a newly invented changeable pattern band and a minute hand with two different patterns serve for the precise indication of each hour and local times of half an hour's difference.

BRIEF DESCRIPTION OF THE DRAWINGS

FIG. 2(*a–c*): A pocket watch, the second embodiment of this invention, the inner ring rotated by a stem/-changeable decorated band on the front/GTS Emblem inside the case/two different pattern motives on the front.

Figure 1C:
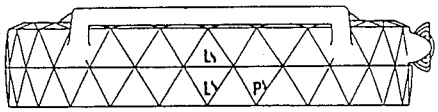
FIG. 1(*a–j*): A wrist watch, the first embodiment of this invention, with a manual rotating ring/GTS Emblem on the back/auxiliary codes on the side/changeable decorated band on the side/two different pattern motives on the minute hand.
FIG. 1*a:* Front view
FIG. 1*b,* 1*c,* 1*d,* 1*e:* Side views
FIG. 1*f:* Rear view
FIG. 1*g:* Front view when Tokyo time is adjusted to Paris time.
FIG. 1*h:* Side view
FIG. 1*i:* Front view when Tokyo time is adjusted to Bombay time.
FIG. 1*j:* Side view
Figure 1D:
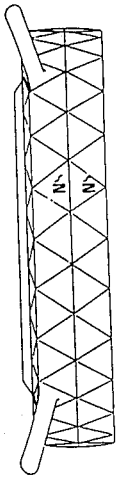
Figure 1A:
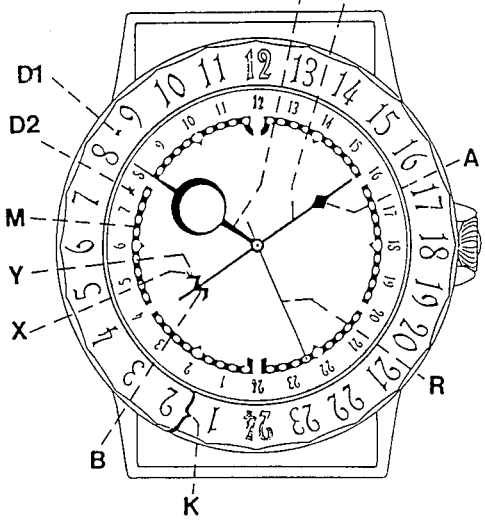
Figure 1B:
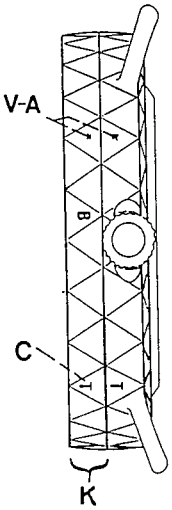
Figure 1E:
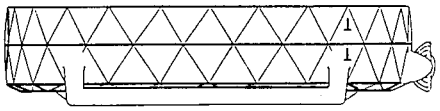

D1: Main dial
D2: Subdial
K: Rotating ring
M: Dial for minute and second
P: Hour hand
Q: Minute hand
R: Second hand
V: Changeable pattern band
A: First pattern motif: in the hour position
B: Second pattern motif: at the half-hour position
X: Small indicator for 40 minutes difference
Y: Small indicator for 45 minutes difference
C: Auxiliary code
E: GTS Emblem

DESCRIPTION OF THE PREFERRED EMBODIMENTS

(A) Hour Dials and Rotating Ring

The hour indication consist of a main dial (D1) and a subdial (D2), the former, being displayed in larger letters or reference characters on the rotating ring, serves to indicate the destination time, and the latter, in smaller letters or reference characters on the body, serves to indicate the home ground time. There are, at least, three possible locations for the rotating ring(K):

(1) To place it on the inner part of the dial plate (FIG. 2).

(2) To place it at the outer part of dial plate (FIG. 3).

(3) To put it on the side of the body (FIG. 1).

The freely rotating ring is moved through a stem in the case of (1), directly with the hand in the case of (3), but either method is possible in the case of (2). And in every case, at the position of each hour, there will be notches so that the rotating ring clicks into place. The dials are of 24 hours and the numerals are displayed in the normal clockwise direction, with the 12 at the top and the 24 at the bottom of the dial circle, because the 12 is found at the top equally in the traditional clock, and particularly in this timepiece can serve as an analogy of the sun, being painted in red.

(B) GTS Indices: Number Code and Auxiliary Code

The numbers from 1 to 24 are utilized also as the number codes of each time zone. Moreover, the initials or codes of the cities representing every time zone are used as an auxiliary code, and for the places where DST is applied a mark of S is added to the code. Where and how the codes are displayed depends on the adopted overall design, and various embodiments can be imagined. A rough grouping, according only to the position of the code, may be done as follows:

(1) Front type . . . the code displayed on the dial plate or the glass at the front of the timepiece.

(2) Side type . . . the code displayed on the sides of the body (FIGS. 1, 3)

Figure 1F:
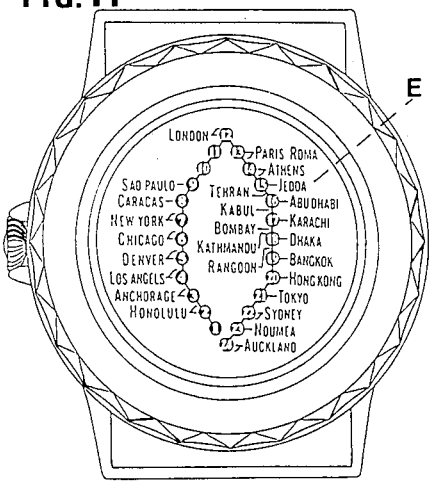
Figure 2A:
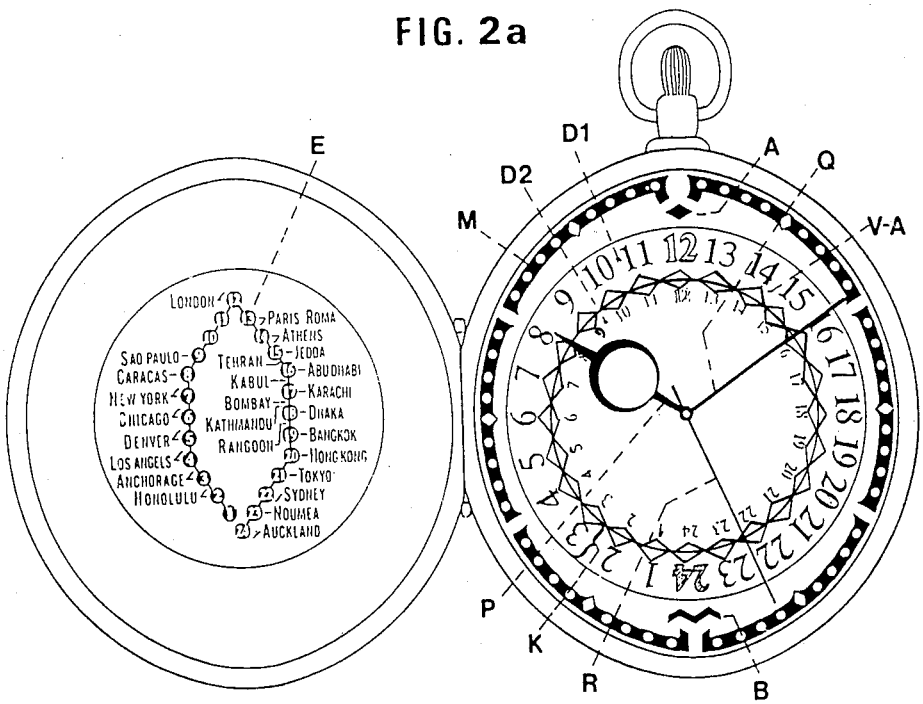
FIG. 2*a:* Front view when the case is open.

(3) Emblem type . . . a complete motif composed of the code (E) displayed on the back, or on the case, or anywhere easy to find (FIGS. 1*f*, 2*a*)

(C) Changeable Pattern Band

A changeable pattern band (V), half of which is comprised of indicia of alignment situated on the rotating ring(K) and the other half is comprised of indicia of alignment on the main body, capable of displaying two different patterns(A,B): one when the main dial on the rotating ring is in the hour position with the letters or characters displayed on one dial radially opposite the letters or characters on the other dial and the other when it is in the half-hour position. The drawings show an example of this band changeable between diamond and zigzag patterns.

(D) Minute and Second Dial and Hands

The dial for minutes and seconds(M) is divided into 60 and there are two modes of displaying it: outside of the hour dial or inside of it. Anyway it must be displayed distinctly from the hour dial. An hour hand(P) rotates once in 24 hours and a minute hand(Q) and a second hand(R) move as in a usual timepiece. The first pattern motif(A), which appears when the rotating main dial takes the hour position, has to be put on the top end of the minute hand, and the second pattern motif(B) which appears when the main dial is in the half-hour position, has to be put on the bottom end of the minute hand. In another design example, these two different pattern motives can be displayed also on the minute dial, the first pattern motif at the top of it and the second pattern motif at the bottom of it. The first mode of display can be applied to all sorts of time pieces, but the second mode is possible only for the clock or watch which can be read even upside down, such as a pocket watch.

(E) Capability of Exploitation in Industry

Figure 1G:
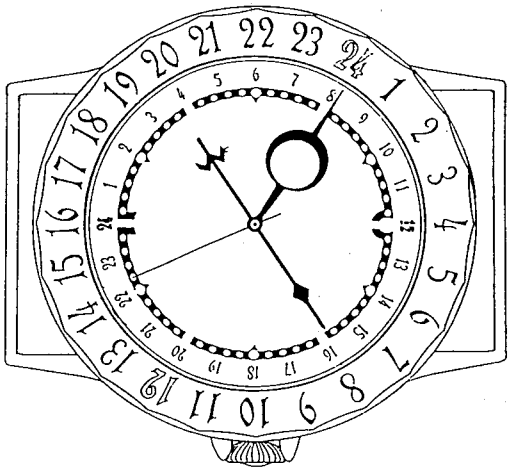
Figure 1H:
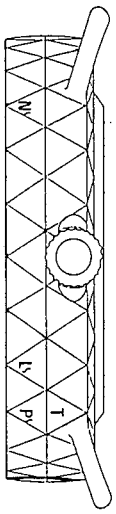
Figure 2B:
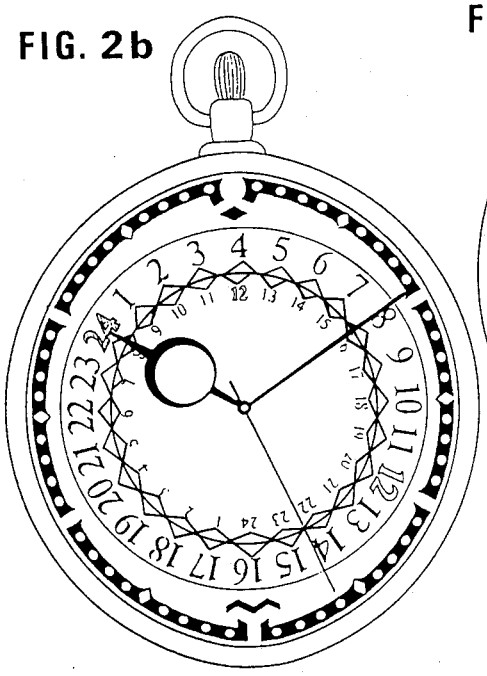
FIG. 2*b:* Front view when Tokyo time is adjusted to Paris time.

The most common way to adjust the time with a timepiece of this invention, is to rotate the main dial in the same direction as the number of the hour difference. But there is another way that could be be said to be really unique to this timepiece. It is to link the destination time code number on the main dial to the home ground time code number on a subdial. If someone goes from Tokyo to Paris, it is enough to move the main dial and to link the number 13 on it to 21 on the subdial. FIGS. 1*g*, 2*b* show the result. If there are marked codes for the cities, it is enough to link them. It is much more speedy than any other way of adjustment.

Figure 1I:
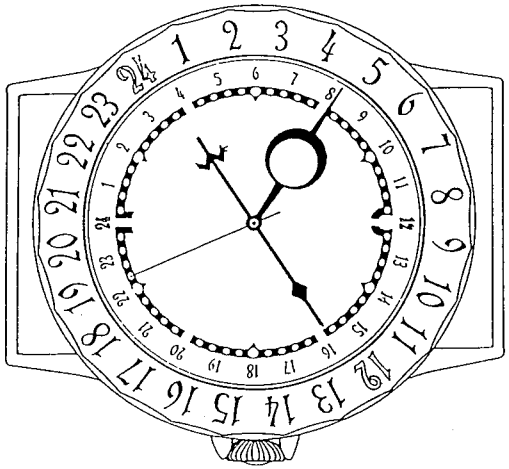
Figure 1J:
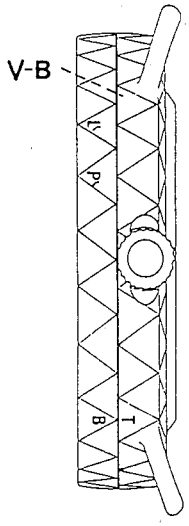
Figure 2C:
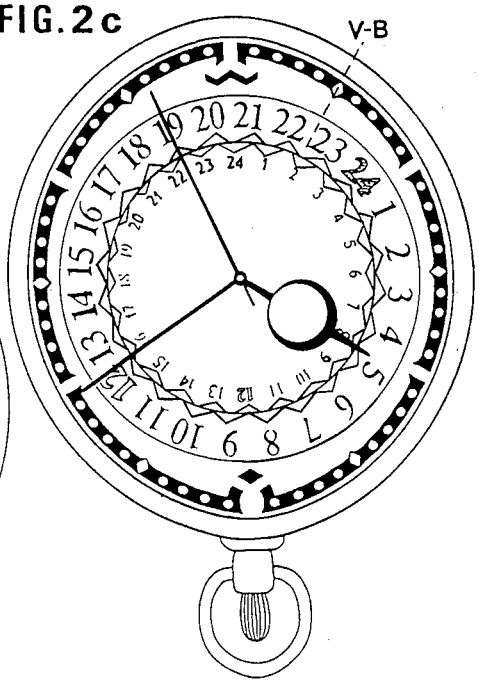
FIG. 2*c:* Front view when Tokyo time is adjusted to Bombay time.
Figure 3C:
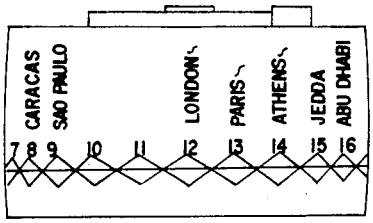
FIG. 3(*a–g*): An alarm clock, the third embodiment of this invention, with a manual rotating ring/a series of numbers, names of cities as auxiliary codes and the changeable decorated band on the side/two different pattern motives on the front.
FIG. 3*a:* Front view
FIG. 3*b,* 3*c,* 3*d,* 3*e:* Side views
FIG. 3*f:* Front view when Tokyo time is adjusted to Bombay time.
FIG. 3*g:* Side view
Figure 3D:
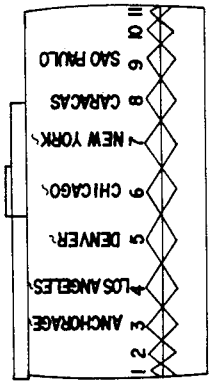
Figure 3A:
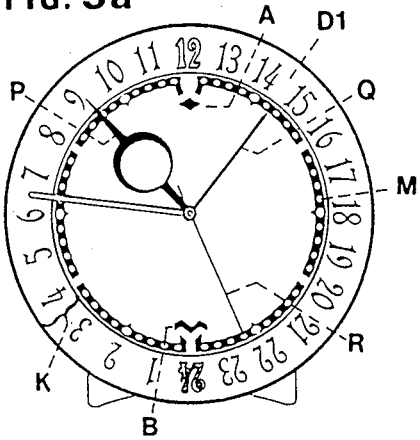
Figure 3B:
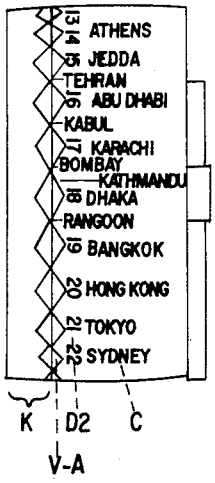
Figure 3E:
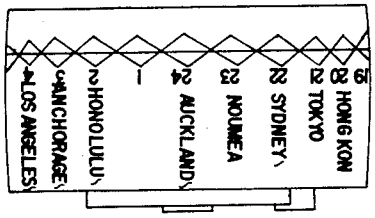
Figure 3G:
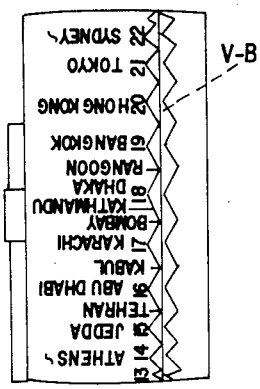
Figure 3F:
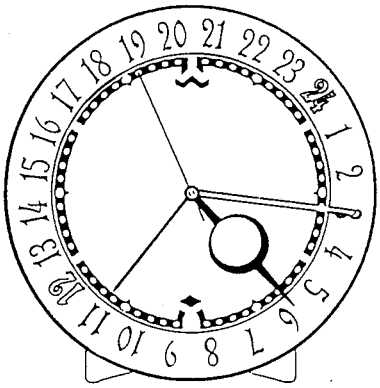

There are many countries in the world where the time difference from GMT is not computed in complete hours. The countries where a half-hour difference applies are: India, Afganistan, Iran, Burma, Sri Lanka, a part of Australia and Canada, and the islands of Cocos, Andaman and Marquesas. However, while travelling between these countries and others it is possible to adjust the time in the same way. If we go from Tokyo to Bombay, simply by linking 17:30 on the main dial to 21 on the subdial, the operation is quickly accomplished. FIGS. 1*i*, 2*c*, 3*f* show this operation. In this case, the pattern band is changed into the zigzag form and we have to read the minutes with the posterior end of the minute hand. Also, other time differences, such as of 40 or 45 minutes can be adjusted and read in a similar way. Although there may be not so many people travelling to and from these aforesaid countries, it is important to have this particular versatility and, indeed, "universality" which this timepiece possesses.

This new timepiece will surely become a necessity—not only for the pilots, but also for travellers: for the peoples of USA, Canada, Mexico, Brazil, Australia, Indonesia, USSR, Zaire, Greenland, Caroline Is., Falkland Is., Marshall Is. and Kiribati where there are time differences even within their own territories, and moreover, in the countries where DST applies. Furthermore, this timepiece is useful not only for travelling but also for use in daily life, because, since it displays the total hours of the day, it enables us to utilize our time more effectively. The cost of production will not be so much higher than that of a traditional watch.

This invention can be adopted for any kind of timepiece, but it will be most suitable for the wristwatch and pocket watch of travellers, the alarm clock or the clock in a car.

I claim:

1. An analog 24-hour timepiece capable of adjustment to simultaneously indicate the time in two different time zones comprising: a body, a first dial secured to said body and including 24 equally spaced reference characters representing 24 hours in a first time zone, a ring mounted for rotation relative to said body and said first dial, a second dial on said ring and including 24 equally spaced reference characters representing 24 hours, said second dial being rotatable with said ring relative to said first dial to position a reference character representing an hour in a second time zone on said second dial relative to a reference character on said first dial, a display of a code correlating a plurality of said reference characters on said first dial and said second dial with time zones, visual alignment means comprising a changeable pattern including first indicia of alignment on said body and second indicia of alignment on said ring, said first and second indicia of alignment establishing a first visual pattern when each of the reference characters on said second dial are radially opposite a reference character on said first dial and establishing a second visual pattern when the reference characters on said second dial are arcuately displaced from the reference characters on said first dial a predetermined arcuate distance less than the arcuate distance between adjacent reference characters on said first dial; an hour hand rotatable about said first dial and said second dial once every 24 hours; a minute and second dial; a minute hand and a second hand.

2. The analog 24-hour timepiece defined by claim 1, wherein said display correlates said reference characters on said first dial and said second dial with said corresponding time zones by relating at least one city in a time zone to a reference character.

3. The analog 24-hour timepiece defined by claim 1, wherein said second visual pattern of said visual alignment means is established when the reference characters on said second dial are rotatably displaced one-half the arcuate distance between adjacent reference characters on said first dial.

* * * * *